US011760088B2

(12) United States Patent
Makita et al.

(10) Patent No.: US 11,760,088 B2
(45) Date of Patent: Sep. 19, 2023

(54) LIQUID DISCHARGE APPARATUS

(71) Applicant: SEIKO EPSON CORPORATION, Tokyo (JP)

(72) Inventors: Shushi Makita, Shiojiri (JP); Masako Fukuda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 14 days.

(21) Appl. No.: 17/305,886

(22) Filed: Jul. 16, 2021

(65) Prior Publication Data

US 2022/0016885 A1 Jan. 20, 2022

(30) Foreign Application Priority Data

Jul. 20, 2020 (JP) ..... 2020-123517

(51) Int. Cl.
*B41J 2/045* (2006.01)

(52) U.S. Cl.
CPC ..... *B41J 2/04596* (2013.01); *B41J 2/04581* (2013.01); *B41J 2/04588* (2013.01); *B41J 2/04595* (2013.01)

(58) Field of Classification Search
CPC ..... B41J 2/04595
See application file for complete search history.

(56) References Cited

U.S. PATENT DOCUMENTS

2007/0140917 A1* 6/2007 Yamashita ..... B41J 2/04588 422/400
2011/0273500 A1* 11/2011 Ishikawa ..... B41J 2/04588 347/10
2012/0081434 A1* 4/2012 Fukuda ..... B41J 2/16526 347/12
2012/0086755 A1* 4/2012 Sayama ..... B41J 2/0459 347/54
2012/0274689 A1* 11/2012 Zhang ..... B41J 2/14274 347/10
2013/0083104 A1* 4/2013 Mitsuki ..... B41J 29/38 347/10
2014/0055513 A1* 2/2014 Usui ..... B41J 2/04595 347/11

FOREIGN PATENT DOCUMENTS

JP 2007-098820 A 4/2007
JP 2010-228196 A 10/2010
JP 2019-059131 A 4/2019

* cited by examiner

*Primary Examiner* — Shelby L Fidler
(74) *Attorney, Agent, or Firm* — WORKMAN NYDEGGER

(57) ABSTRACT

A liquid discharge apparatus includes a drive signal generation section configured to generate a plurality of drive pulses that is supplied to a pressure generation unit to change a pressure in liquid in a pressure chamber communicated with a nozzle. The plurality of drive pulses include: first and second discharge pulses to discharge liquid from the nozzle; and first and second micro-vibration pulses to not discharge liquid. The first discharge pulse and the first micro-vibration pulse are included in a first period included in a repetition cycle. The second discharge pulse and the second micro-vibration pulse are included in a second period included in the repetition cycle and later than the first period. The length from a start of the first period to the first micro-vibration pulse differs from the length from a start of the second period to the second micro-vibration pulse.

5 Claims, 9 Drawing Sheets

LIQUID DISCHARGE APPARATUS

The present application is based on, and claims priority from JP Application Serial Number 2020-123517, filed Jul. 20, 2020, the disclosure of which is hereby incorporated by reference herein in its entirety.

BACKGROUND

1. Technical Field

The present disclosure relates to a liquid discharge apparatus.

2. Related Art

Printers that discharge droplets from a print head onto a print medium while changing the relative position of the print head to the print medium are widely used at present. In such a printer, timing signals are repeatedly generated in accordance with changes of the relative position between the print medium and the print head. Drive waveforms are generated at the timing in accordance with the timing signals and are supplied to an element that discharges liquid.

In the technique disclosed in JP-A-2019-59131, a drive signal including a drive waveform for recording dots in two pixels is generated in one section of a timing signal generated repeatedly. The drive signal includes discharge pulses for individually discharging liquid from nozzles of a print head in a first period and a second period included in one section of the timing signal. The first period and the second period individually correspond to one pixel.

The drive signal may include a micro-vibration pulse instead of a discharge pulse in one or both of the first period and the second period included in one section of the timing signal. A micro-vibration pulse is a pulse that vibrates liquid in a nozzle of a print head without discharging liquid from the nozzle of the print head. In each of the first period and the second period, a discharge pulse or a micro-vibration pulse included in a drive signal is selected in accordance with image data representing an image to be formed on a print medium, and is supplied to an element that discharges liquid.

Liquid discharge performed by a later discharge pulse sometimes becomes unstable depending on the combination of the pulses selected in the first period and the second period that are repeated. Specifically, the amount of liquid discharged, the discharge direction, and the timing of discharging liquid sometimes differ from the amount, the direction, and the timing that were assumed in advance.

SUMMARY

According to an aspect of the present disclosure, there is provided a liquid discharge apparatus. The liquid discharge apparatus includes: a head including a nozzle, a pressure chamber communicating with the nozzle, and a pressure generation unit causing a pressure change in liquid in the pressure chamber; a drive signal generation section configured to repeatedly generate a first drive signal including a plurality of drive pulses in a repetition cycle and a second drive signal including a plurality of drive pulses in the repetition cycle, the first drive signal being in synchronism with the second drive signal; and a drive controller configured to supply a pulse selected from the plurality of drive pulses included in the first drive signal or the second drive signal to the pressure generation unit. The plurality of drive pulses include a first discharge pulse and a second discharge pulse that generate the pressure change so as to discharge liquid from the nozzle and a first micro-vibration pulse and a second micro-vibration pulse that generate the pressure change so as not to discharge liquid from the nozzle. The first drive signal includes one of the first discharge pulse and the first micro-vibration pulse in a first period included in the repetition cycle, and includes one of the second discharge pulse and the second micro-vibration pulse in a second period included in the repetition cycle and later than the first period. The second drive signal includes the other of the first discharge pulse and the first micro-vibration pulse in the first period and includes the other of the second discharge pulse and the second micro-vibration pulse in the second period. The length of a period from a start of the first period to a start of the first micro-vibration pulse differs from the length of a period from a start of the second period to a start of the second micro-vibration pulse.

DESCRIPTION OF EXEMPLARY EMBODIMENTS

1. First Embodiment

1.1 Mechanical Configuration of Liquid Discharge Apparatus

Figure 1:
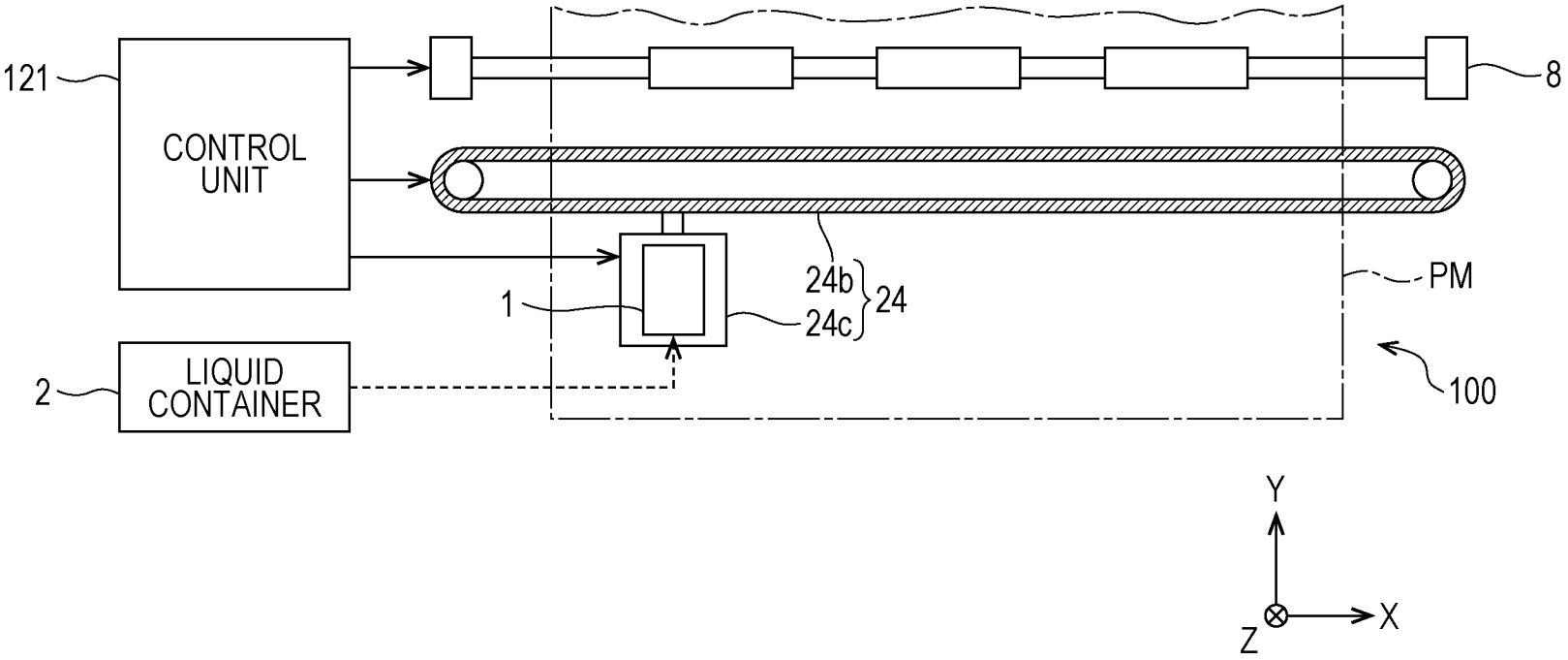
FIG. 1 is an explanatory diagram illustrating a liquid discharge apparatus according to a first embodiment.

FIG. 1 is an explanatory diagram illustrating a liquid discharge apparatus 100 according to a first embodiment. The liquid discharge apparatus 100 is an ink jet printer that discharges ink, which is liquid, onto a medium PM. It is possible to attach a liquid container 2 that stores ink to the liquid discharge apparatus 100 and to set the medium PM on the liquid discharge apparatus 100. The liquid discharge apparatus 100 is configured to discharge ink in the liquid container 2 onto the medium PM. The liquid discharge apparatus 100 includes a liquid discharge head 1, a movement mechanism 24, a transport mechanism 8, and a control unit 121.

The liquid discharge head 1 includes a plurality of nozzles. The liquid discharge head 1 discharges ink, which is liquid supplied from the liquid container 2, from the plurality of nozzles. The ink discharged from the nozzles impacts on the medium PM disposed at a predetermined position in the liquid discharge apparatus 100. A detailed description will be given later of the configuration of the liquid discharge head 1.

The movement mechanism 24 includes a ring-shaped belt 24*b* and a carriage 24*c*, which is fixed to the belt 24*b* and configured to hold the liquid discharge head 1. The movement mechanism 24 is configured to rotate the ring-shaped belt 24*b* in both directions so as to reciprocate the liquid discharge head 1 in the X-direction. The position of the carriage 24*c* in the X-direction is detected based on pulses sent by an encoder disposed in the liquid discharge apparatus 100.

A transport mechanism 8 transports the medium PM in the −Y-direction while the liquid discharge head 1 is moved a plurality of times by the movement mechanism 24. The Y-direction is a direction perpendicular to the X-direction. As a result, an image is formed on the medium PM by ink discharged onto a virtual face designated by the X-direction and the Y-direction.

It is assumed that a direction perpendicular to the X-direction and the Y-direction is the Z-direction. The liquid discharge head 1 discharges ink in the Z-direction while being transported in the X-direction.

The control unit 121 controls the discharge operation of ink from the liquid discharge head 1. The control unit 121 controls the transport mechanism 8, the movement mechanism 24, and the liquid discharge head 1 to form an image on the medium PM.

Figure 2:
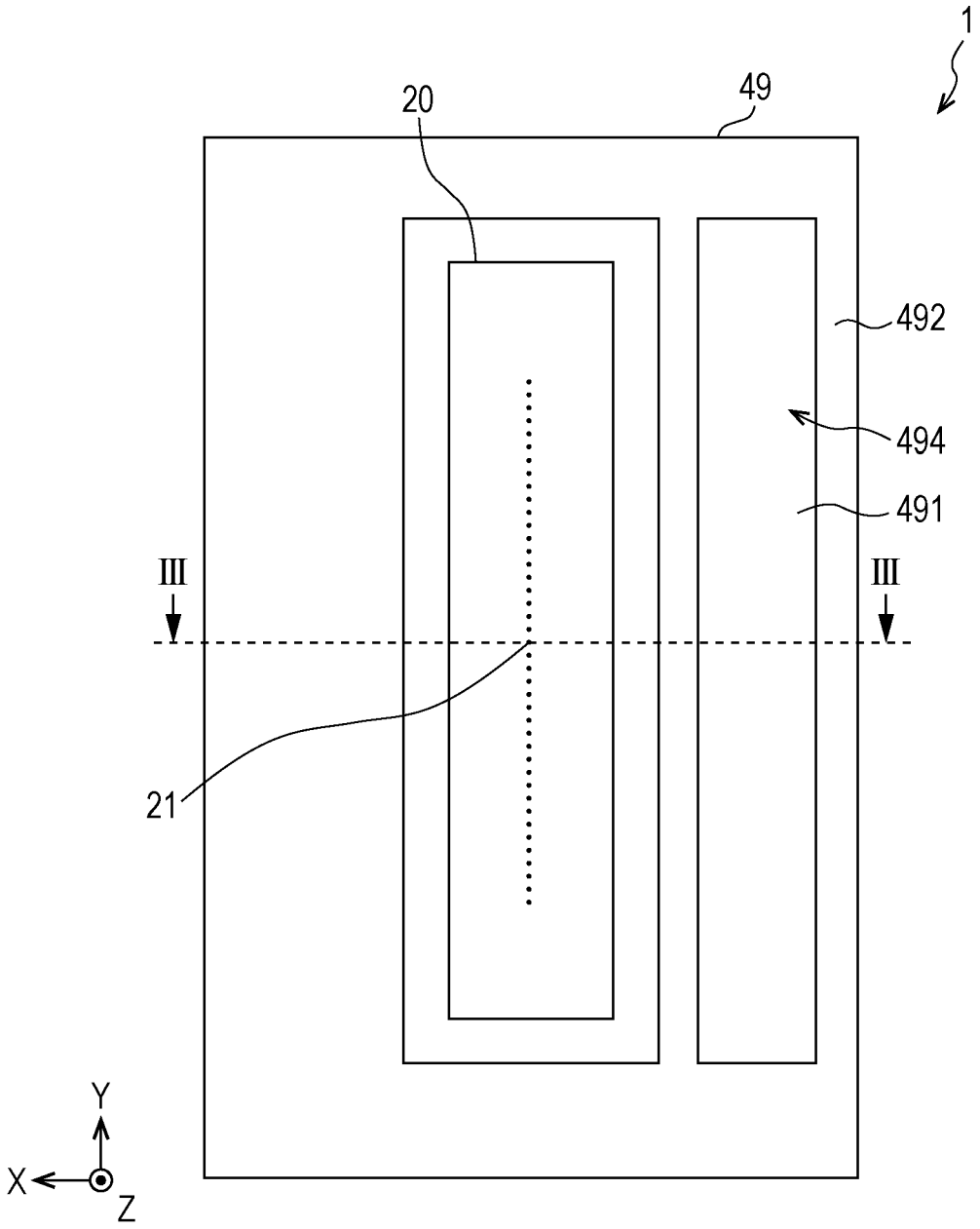
FIG. 2 is a plan view of a liquid discharge head.

FIG. 2 is a plan view of the liquid discharge head 1. The liquid discharge head 1 according to the present embodiment is an ink jet recording head. The liquid discharge head 1 discharges ink droplets from nozzles 21. The nozzles 21 are disposed in a straight line in the Y-direction on a nozzle plate 20 disposed in parallel with the XY-plane.

Figure 3:
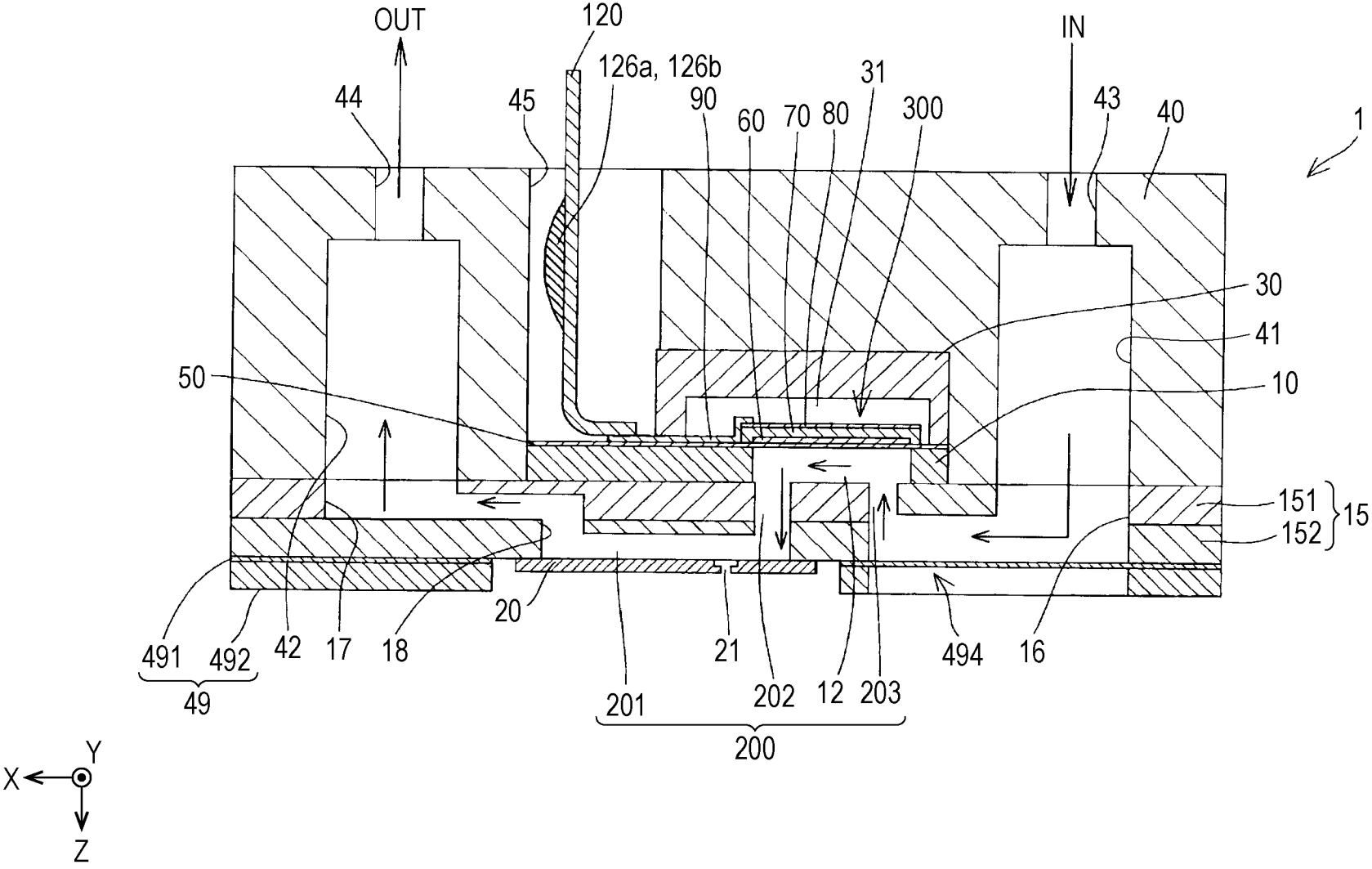
FIG. 3 is a sectional view taken on line III-III of FIG. 2.

FIG. 3 is a sectional view taken on line III-III of FIG. 2. The liquid discharge head 1 includes a flow path forming substrate 10, a communication plate 15, the nozzle plate 20, a compliance substrate 49, a vibration plate 50, a piezoelectric actuator 300, a protection substrate 30, and a case member 40.

The flow path forming substrate 10 includes a plurality of pressure chambers 12 (refer to the lower center part of FIG. 3). The plurality of pressure chambers 12 are disposed side by side in the Y-direction. One of the pressure chambers 12 communicates with a corresponding one of the nozzles 21.

The communication plate 15 is disposed on the plus side in the Z-direction with respect to the flow path forming substrate 10 in contact with the flow path forming substrate 10. The communication plate 15 includes a first communication plate 151 and a second communication plate 152. The communication plate 15 includes one first communication section 16, one second communication section 17, one third communication section 18, a plurality of first flow paths 201, a plurality of second flow paths 202, and a plurality of supply paths 203.

The first communication section 16 communicates with a first liquid chamber 41 of the case member 40 (refer to the lower right part of FIG. 3). In the communication plate 15, ink flows from the first communication section 16 to the third communication section 18 through multiple sets of supply paths 203, pressure chambers 12, second flow paths 202, and first flow paths 201. A supply path 203, a pressure chamber 12, a second flow path 202, and a first flow path 201 are collectively called an individual flow path 200. An individual flow path 200 is coupled to a corresponding one of the nozzles 21. Ink that has flowed through a plurality of individual flow paths 200 goes through one third communication section 18 to one second communication section 17. The second communication section 17 communicates with a second liquid chamber 42 of the case member 40 (refer to the lower left part of FIG. 3). In FIG. 3, the flow direction of ink is indicated by an arrow in a vacant space.

The nozzle plate 20 is disposed on the plus side in the Z-direction with respect to the communication plate 15 in contact with the communication plate 15 (refer to the lower part of FIG. 3). The nozzle plate 20 closes the first flow path 201, the second flow path 202, and the third communication section 18, which are open on the plus side in the Z-direction in the communication plate 15, on the plus side in the Z-direction of the communication plate 15.

The nozzle plate 20 includes nozzles 21 on the portion that closes the first flow path 201. The nozzles 21 are disposed in a straight line in the Y-direction on a nozzle plate 20 disposed in parallel with the XY-plane (refer to FIG. 2).

The compliance substrate 49 is disposed on the plus side in the Z-direction with respect to the communication plate 15 in contact with the communication plate 15 (refer to the lower part of FIG. 3). The compliance substrate 49 closes on the plus side in the Z-direction with respect to the first communication section 16 that is open on the plus side in the Z direction on the communication plate 15 (refer to the lower right part of FIG. 3). The compliance substrate 49 includes a sealing film 491 and a fixing substrate 492.

The part of the compliance substrate 49 that seals the first communication section 16 of the communication plate 15 is provided with the sealing film 491, but is not provided with the fixing substrate 492 (refer to the lower right part of FIG. 3). The sealing film 491 is elastically deformed so as to relieve a pressure change in the first communication section 16. The part of the compliance substrate 49 that seals the first communication section 16 of the communication plate 15 may be referred to as a compliance section 494.

The vibration plate 50 is disposed on the minus side in the Z-direction with respect to the flow path forming substrate 10 in contact with the flow path forming substrate 10 (refer to the lower right part of FIG. 3). The vibration plate 50 closes the pressure chamber 12, which is open to the minus side in the Z-direction of the flow path forming substrate 10, on the minus side in the Z-direction of the flow path forming substrate 10.

The piezoelectric actuator 300 is disposed on the minus side in the Z-direction with respect to the vibration plate 50 in contact with the vibration plate 50 (refer to the center part of FIG. 3). A plurality of piezoelectric actuators 300 are individually disposed at the corresponding positions facing the corresponding pressure chambers 12 by sandwiching the corresponding vibration plates 50. The piezoelectric actuator 300 includes a first electrode 60, a piezoelectric layer 70, and a second electrode 80.

Each of the second electrodes 80 is coupled to a corresponding lead electrode 90 (refer to the center of FIG. 3). A voltage is selectively applied to each of the piezoelectric actuators 300 via the corresponding lead electrode 90. When a voltage is applied to the piezoelectric layer 70 by the first electrode 60 and the second electrode 80, the piezoelectric layer 70 is deformed. The vibration plate 50 disposed in contact with the piezoelectric actuator 300 is deformed by the deformation of the piezoelectric layer 70 and gives pressure on the ink in the pressure chamber 12. As a result, a pressure change occurs in the ink in the pressure chamber 12. The pressure is transmitted via the ink in the second flow path 202 to the ink in the first flow path 201, and thus ink is discharged from the nozzles 21.

The protection substrate 30 is disposed on the minus side in the Z-direction with respect to the vibration plate 50 with a part of the protection substrate 30 in contact with the vibration plate 50 (refer to the center part of FIG. 3). The protection substrate 30 includes a piezoelectric actuator holding section 31, which is a vacant space that accommodates a plurality of piezoelectric actuators 300. The piezoelectric actuator holding section 31 is one recess having an opening on the plus side in the Z-direction. In the piezoelectric actuator holding section 31, the plurality of piezoelectric actuators 300 are configured to be deformed.

A part of the lead electrode 90 is coupled to a flexible cable 120. The flexible cable 120 includes drive circuits 126*a* and 126*b*, which are semiconductor elements.

The case member 40 is disposed on the minus side in the Z-direction with respect to the communication plate 15 and the protection substrate 30 in contact with the communication plate 15 and the protection substrate 30 (refer to the upper part of FIG. 3). The case member 40 includes the first liquid chamber 41, the second liquid chamber 42, an inlet 43, a discharge opening 44, and a coupling hole 45.

In the case member 40, ink is introduced from the inlet 43 and is supplied to the communication plate 15 via the first liquid chamber 41 (refer to an arrow IN in the upper right part of FIG. 3). The ink supplied from the communication plate 15 goes through the second liquid chamber 42 and is discharged from the discharge opening 44 to a temporary storage section (refer to an arrow OUT in the upper left part of FIG. 3). The ink discharged in the temporary storage section is introduced again from the inlet 43. That is to say, in the present embodiment, ink circulates between the liquid discharge head 1 and the temporary storage section disposed outside the liquid discharge head 1.

The coupling hole 45 is a through hole in the Z-direction of the case member 40 (refer to the upper center part of FIG. 3). A part of the exposed lead electrode 90 is coupled to the flexible cable 120 disposed through the coupling hole 45.

1.2 Electrical Configuration of Liquid Discharge Apparatus 100

Figure 4:
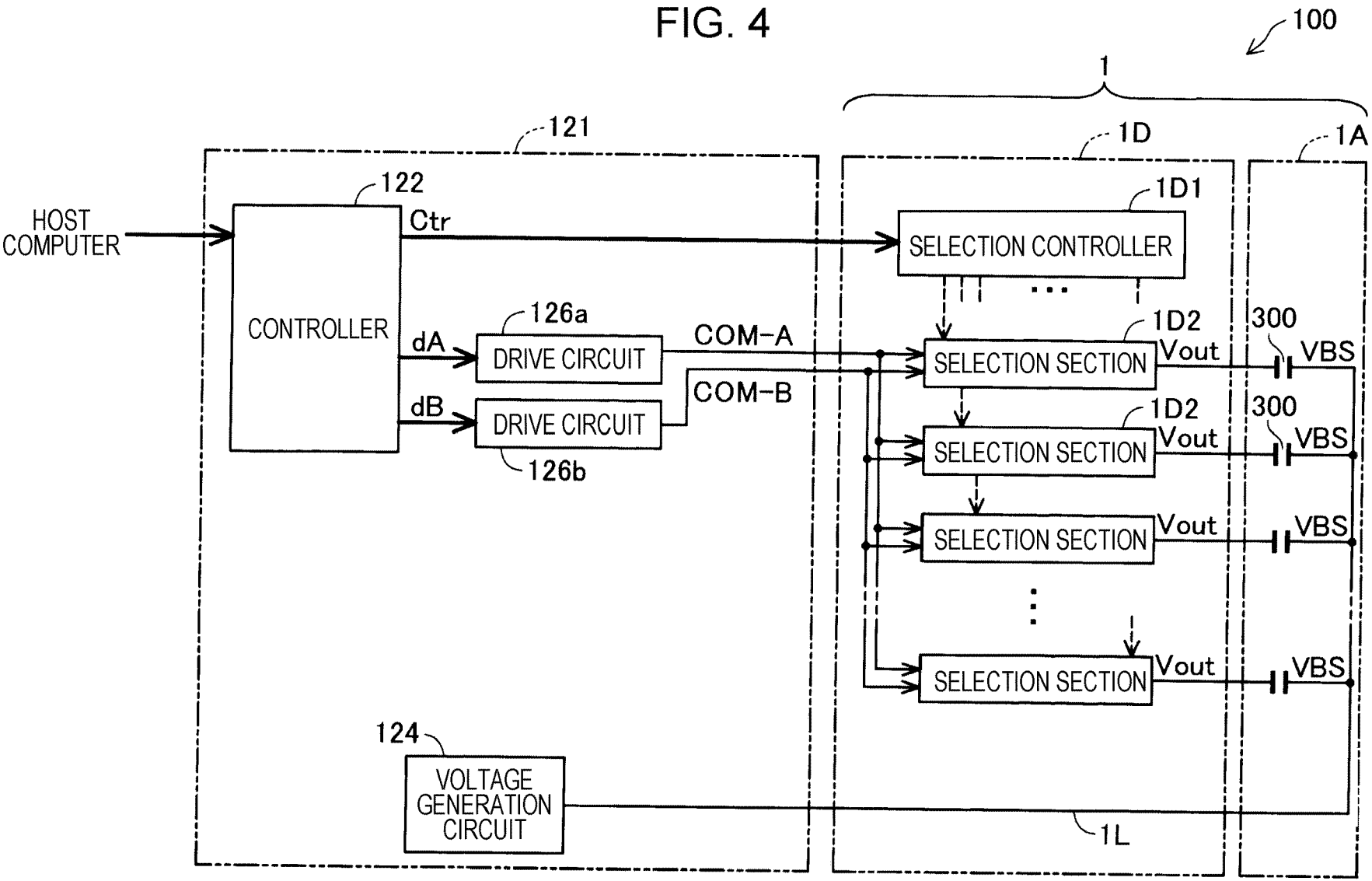
FIG. 4 is a block diagram illustrating the electrical configuration of the liquid discharge apparatus.

FIG. 4 is a block diagram illustrating the electrical configuration of the liquid discharge apparatus 100. The control unit 121 applies electric signals to the piezoelectric actuator 300 of the liquid discharge head 1 so as to control driving of the piezoelectric actuator 300.

The control unit 121 supplies a control signal Ctr, drive signals COM-A and COM-B, and a voltage VBS holding signal to the liquid discharge head 1 (refer to the left part of FIG. 4). The liquid discharge head 1 drives the piezoelectric actuators 300 in accordance with the control signal Ctr, the drive signals COM-A and COM-B, and the voltage VBS that have been received from the control unit 121 so as to discharge ink from the nozzles 21.

The control unit 121 includes a controller 122, the drive circuits 126*a* and 126*b*, and a voltage generation circuit 124. The controller 122 is a microcomputer including a CPU, a RAM, a ROM, and the like (refer to the upper left part of FIG. 4). The controller 122 is configured to cause the CPU to execute a predetermined program so as to output various control signals for controlling each section of the liquid discharge apparatus 100, and the like based on image data.

The controller 122 controls the movement mechanism 24 and the transport mechanism 8 (refer to FIG. 1). The controller 122 is configured to recognize the scanning position of the liquid discharge head 1 mounted on the carriage 24*c* based on the encoder pulses output from the encoder in accordance with the scanning position of the carriage 24*c*. The controller 122 generates a timing signal PTS based on the encoder pulses and supplies the various kinds of the control signal Ctr to the liquid discharge head 1 in synchronism with the timing pulse PTS (refer to the upper part of FIG. 4). The control signal Ctr includes a print data signal indicating any one of a "large dot", a "medium dot", a "small dot" and "non-recording", a plurality of kinds of control signals that control discharging ink from the nozzles 21, such as a LAT signal specifying the latch timing of print data, and a CH signal specifying the selection timing of each drive pulse included in the first drive signal COM-A and the second drive signal COM-B, and the like, a clock signal to be used for transferring print data, and the like. The controller 122 generates LATp11, which is the first LAT signal, based on the timing pulse PTS, after that generates LATp12, which is the second LAT signal, and generates each change signal CH on the condition of elapse of a specified time from LATp11 and LATp12. The controller 122 supplies digital data dA to the drive circuit 126*a* (refer to the upper left part of FIG. 4). The controller 122 supplies digital data dB to the drive circuit 126*b*.

The drive circuit 126*a* performs analog conversion on the data dA to produce a signal, further amplifies the signal, and outputs the signal as the first drive signal COM-A to the liquid discharge head 1 (refer to the upper left part of FIG. 4). The drive circuit 126*b* performs analog conversion on the data dB to produce a signal, further amplifies the signal, and outputs the signal as the second drive signal COM-B to the liquid discharge head 1. As a result, the control unit 121 repeatedly generates the first drive signal COM-A including a plurality of drive pulses and the second drive signal COM-B including a plurality of drive pulses in synchronism with the timing signal PTS. The repetition cycle may be referred to as a "print cycle". The hardware configurations of the drive circuits 126*a* and 126*b* are the same.

The voltage generation circuit 124 generates a holding signal having a constant voltage VBS and outputs the signal to the liquid discharge head 1 (refer to the lower left part of FIG. 4). The holding signal keeps constant the potential of a common electrode of the plurality of piezoelectric actuators 300 on an actuator substrate 1A (refer to the right side of the piezoelectric actuator 300 in FIG. 4 and reference numeral 60 in FIG. 3).

The liquid discharge head 1 includes the actuator substrate 1A and a drive IC 1D (refer to the right part of FIG. 4). In this regard, the actuator substrate 1A and the drive IC 1D are conceptual divisions in an electrical configuration, and these names do not necessarily mean that these components are individually realized by one substrate or one IC.

The drive IC 1D supplies a drive signal to a corresponding electrode of each piezoelectric actuator 300 on the actuator substrate 1A (refer to the left side of the piezoelectric actuators 300 in FIG. 4 and reference numeral 80 in FIG. 3). The drive IC 1D relays a holding signal received from the voltage generation circuit 124 of the control unit 121 to a common electrode of the individual piezoelectric actuators 300 on the actuator substrate 1A (refer to the right side of the piezoelectric actuator 300 in FIG. 4 and reference numeral 60 in FIG. 3).

The drive IC 1D includes a selection controller 1D1 and selection sections 1D2 each of which has a one-to-one relationship with a corresponding one of the piezoelectric actuators 300 (refer to the right part of FIG. 4). The selection controller 1D1 instructs each of the selection sections 1D2 to select either the first drive signal COM-A or the second drive signal COM-B by using the clock signal output from the controller 122, the print data signal, the LAT signal, and the CH signal. More specifically, the selection controller 1D1 stores in a shift register the print data signals supplied from the controller 122 for as many as the number of the piezoelectric actuators 300 in the liquid discharge head 1 in synchronism with the clock signal. When the LAT signal is input, the selection controller 1D1 latches the print data signal by using a latch circuit, and outputs a selection signal decoded by a decoder from the print data signal to each of the selection sections 1D2 at a timing specified by the LAT signal and the CH signal.

Each of the selection sections 1D2 selects either the drive signal COM-A or the drive signal COM-B, or none of the drive signals in accordance with an instruction from the selection controller 1D1 to apply the drive signal of the voltage Vout to an individual electrode of a corresponding one of the piezoelectric actuators 300 (refer to the left side of the piezoelectric actuators 300 in FIG. 4). The pulses selected from the plurality of drive pulses included in the first drive signal COM-A and the second drive signal COM-B are supplied from the drive IC 1D to the piezoelectric actuators 300. The drive signal of the voltage Vout is specifically applied to the second electrode 80 of a corresponding one of the piezoelectric actuators 300 (refer to FIG. 3).

The actuator substrate 1A includes the plurality of piezoelectric actuators 300. One of the electrodes of each of the piezoelectric actuators 300, the second electrode 80, is individually disposed, but the other of the electrodes, the first electrode 60, is disposed as an electrode common to the plurality of piezoelectric actuators 300. A voltage Vout having a different waveform depending on the size of a dot to be formed is applied to an individual second electrode 80 of the plurality of piezoelectric actuators 300 as a drive signal (refer to the left side of the piezoelectric actuators 300 in FIG. 4). A constant voltage VBS is applied by the holding signal via a wiring pattern 1L to the first electrode 60 common to the plurality of piezoelectric actuators 300 (refer to the right side of the piezoelectric actuators 300 in FIG. 4).

1.3 Configuration of Drive Signal

Figure 5:
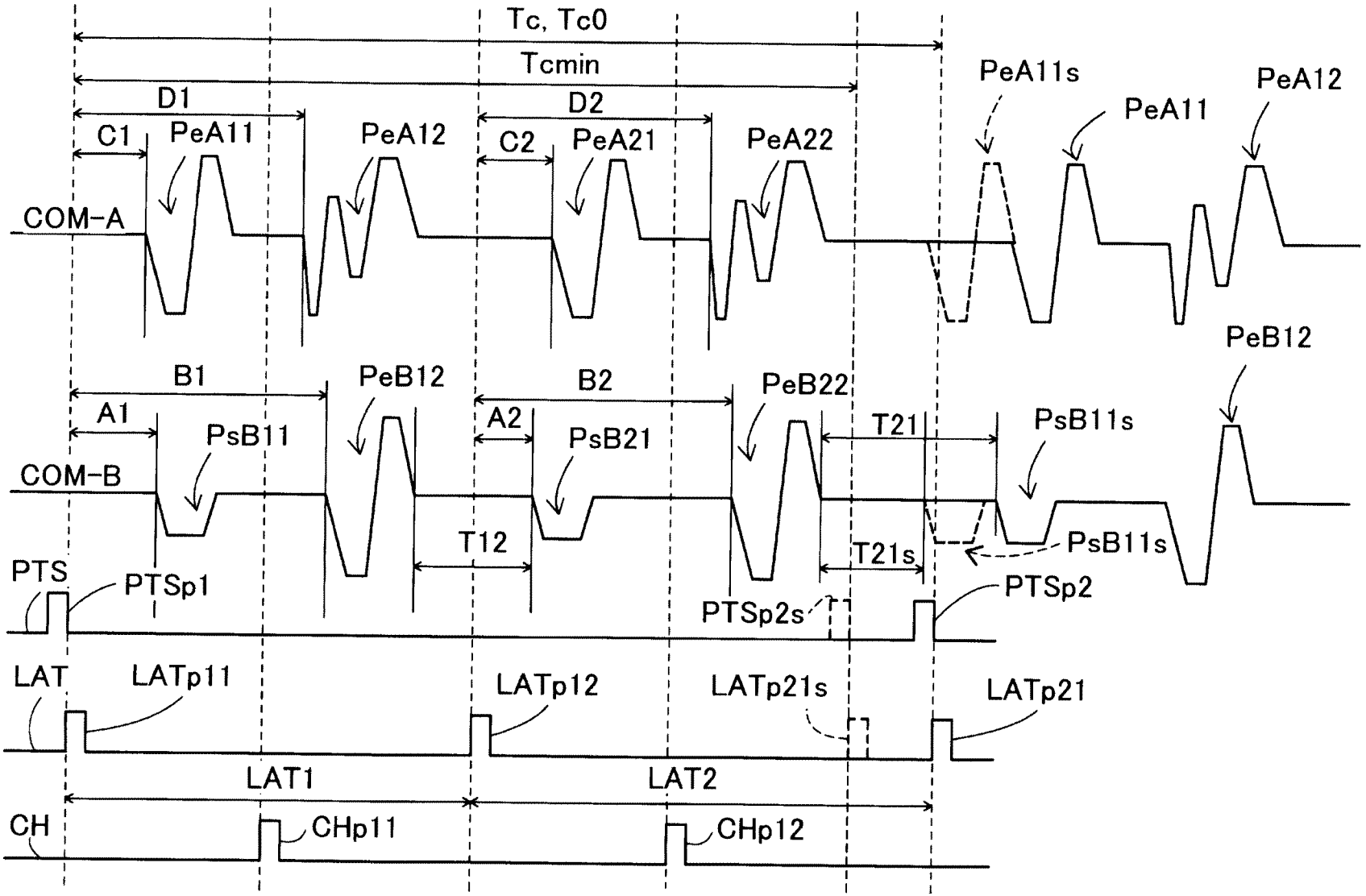
FIG. 5 is a chart illustrating the configuration of a first drive signal COM-A and a second drive signal COM-B.

FIG. 5 is a chart illustrating the configuration of the first drive signal COM-A and the second drive signal COM-B. As described above, the control unit 121 repeatedly generates the first drive signal COM-A including a plurality of drive pulses and the second drive signal COM-B including a plurality of drive pulses in synchronism with each other (refer to the upper part of FIG. 5 and the center part of FIG. 4). In this regard, the waveforms of the first drive signal COM-A and the second drive signal COM-B illustrated in FIG. 5 are simplified to facilitate understanding of the technology, and do not truly represents the actual waveforms.

The control unit 121 repeatedly generates the timing signal PTS in accordance with a change of the relative position between the medium PM and the liquid discharge head 1 (refer to the lower part of FIG. 5). Specifically, the timing signal PTS is generated based on the signal sent from the encoder for detecting the position of the carriage 24*c*. Dots for two pixels are recorded on the medium PM by the ink discharged from the nozzles 21 in the time section between the adjacent timing signals PTS. In FIG. 5, a pulse of the timing signal PTS that specifies the front end of a certain print cycle Tc is denoted by PTSp1 (refer to the lower left part of FIG. 5). A pulse of the timing signal PTS that specifies the rear end of a certain print cycle Tc and the front end of the next print cycle Tc is denoted by PTSp2 (refer to the lower right part of FIG. 5).

The controller 122 outputs a pulse of the LAT signal at the time (i) when a pulse of the timing signal PTS is received and at the time (ii) when a certain time period shorter than ½ of a reference value Tc0 of the repetition cycle of the timing signal PTS has passed from receiving a pulse of the timing signal PTS (refer to the lower part of FIG. 5). The reference value Tc0 of the repetition cycle refers to the repetition cycle Tc of the timing signal PTS when the carriage 24*c* on which the liquid discharge head 1 is mounted is ideally reciprocated in the X-direction. A dot for one pixel is recorded on the medium PM by the ink discharged from the nozzle 21 in the time section between adjacent pulses of the LAT signal.

One print cycle Tc includes a first period LAT1 and a second period LAT2, which are divided by a pulse of the LAT signal (refer to the lower part of FIG. 5). The first period LAT1 is a time section including the front end of the print cycle Tc (refer to the upper part of FIG. 5). The second period LAT2 is a period positioned after the first period LAT1. The second period LAT2 is a time section including the rear end of the print cycle Tc. The first period LAT1 and the second period LAT2 individually correspond to the periods in which ink for one pixel is discharged.

In FIG. 5, a pulse of the LAT signal that specifies the front end of the first period LAT1 matching the front end of a certain print cycle Tc is denoted by LATp11 (refer to the lower left part of FIG. 5). A pulse of the LAT signal that specifies the rear end of the first period LAT1 and the front end of the next second period LAT2 is denoted by LATp12 (refer to the lower center part of FIG. 5). A pulse of the LAT signal that specifies the rear end of the second period LAT2 and the front end of the next first period LAT1 is denoted by LATp21 (refer to the lower center part of FIG. 5). When referring to the first period LAT1 and the second period LAT2 without distinction, they are collectively expressed as "LAT period".

The controller 122 outputs the CH signal at the time (i) when time has passed from receiving a pulse of the timing signal PTS to a drive pulse included in the first period LAT1 and at the time (ii) when time has passed from receiving a pulse of the timing signal PTS to a drive pulse included in the second period LAT2 (refer to the lower part of FIG. 5 and the right part of FIG. 4). A CH signal is a signal that specifies the selection timing of each drive pulse included in the first drive signal COM-A and the second drive signal COM-B.

In FIG. 5, a pulse of the CH signal that represents substantially intermediate time of the first period LAT1 is denoted by CHp11 (refer to the lower left part of FIG. 5). A pulse of the CH signal that represents substantially intermediate time of the second period LAT2 is denoted by CHp12 (refer to the lower left part of FIG. 5).

The plurality of drive pulses included in the first drive signal COM-A include a first discharge pulse PeA11 and a second discharge pulse PeA21 (refer to the upper right part of FIG. 5). The plurality of drive pulses included in the first drive signal COM-A further include a fifth discharge pulse PeA12 and a sixth discharge pulse PeA22 (refer to the upper center part of FIG. 5).

The first discharge pulse PeA11 is disposed in the first period LAT1 and causes to generate a pressure change so as to discharge liquid from the nozzle 21. The second discharge pulse PeA21 is disposed in the second period LAT2 and causes to generate a pressure change so as to discharge liquid from the nozzle 21. The waveforms of the first discharge pulse PeA11 and the second discharge pulse PeA21 are the same (refer to the upper right part of FIG. 5).

A length C1 of the period from the start of the first period LAT1 to the start of the first discharge pulse PeA11 is equal to a length C2 of the period from the start of the second period LAT2 to the start of the second discharge pulse PeA21. With such a configuration, it is possible to substantially match the dot position in a pixel formed by the first discharge pulse PeA11 in the first period LAT1 with the dot position in a pixel formed by the second discharge pulse PeA21 in the second period LAT2.

The fifth discharge pulse PeA12 is disposed after the first discharge pulse PeA11 in the first period LAT1 and causes to generate a pressure change so as to discharge liquid from the nozzle 21. The sixth discharge pulse PeA22 is disposed after the second discharge pulse PeA21 in the second period LAT2 and causes to generate a pressure change so as to discharge liquid from the nozzle 21. The waveform of the fifth discharge pulse PeA12 is the same as the waveform of the sixth discharge pulse PeA22 (refer to the upper center part of FIG. 5).

A length D1 of the period from the start of the first period LAT1 to the start of the fifth discharge pulse PeA12 is equal to a length D2 of the period from the start of the second period LAT2 to the start of the sixth discharge pulse PeA22. With such a configuration, it is possible to substantially match the dot position in a pixel formed by the fifth discharge pulse PeA12 in the first period LAT1 with the dot position in a pixel formed by the sixth discharge pulse PeA22 in the second period LAT2.

The plurality of drive pulses included in the second drive signal COM-B include a first micro-vibration pulse PsB11 and a second micro-vibration pulse PsB21 (refer to the middle right part of FIG. 5). The plurality of drive pulses included in the second drive signal COM-B further include a third discharge pulse PeB12 and a fourth discharge pulse PeB22 (refer to the middle center part of FIG. 5).

The first micro-vibration pulse PsB11 is disposed in the first period LAT1 and causes to generate a pressure change so as not to discharge ink from the nozzle 21. The second micro-vibration pulse PsB21 is disposed in the second period LAT2 and causes to generate a pressure change so as not to discharge ink from the nozzle 21. The waveform of the first micro-vibration pulse PsB11 is the same as the waveform of the second micro-vibration pulse PsB21 (refer to upper center part of FIG. 5).

A length A1 of the period from the start of the first period LAT1 to the start of the first micro-vibration pulse PsB11 differs from a length A2 of the period from the start of the second period LAT2 to the start of the second micro-vibration pulse PsB21. More specifically, the length A1 of the period from the start of the first period LAT1 to the start of the first micro-vibration pulse PsB11 is longer than the length A2 of the period from the start of the second period LAT2 to the start of the second micro-vibration pulse PsB21.

The third discharge pulse PeB12 is disposed after the first micro-vibration pulse PsB11 in the first period LAT1 and causes to generate a pressure change so as to discharge liquid from the nozzle 21. The fourth discharge pulse PeB22 is disposed after the second micro-vibration pulse PsB21 in the second period LAT2 and causes to generate a pressure change so as to discharge liquid from the nozzle 21. The waveforms of the third discharge pulse PeB12 and the fourth discharge pulse PeB22 are the same as the waveforms of the first discharge pulse PeA11 and the second discharge pulse PeA21 of the drive signal COM-A (refer to the middle center part of FIG. 5).

A length B1 of the period from the start of the first period LAT1 to the start of the third discharge pulse PeB12 is equal to a length B2 of the period from the start of the second period LAT2 to the start of the fourth discharge pulse PeB22. With such a configuration, it is possible to substantially match the dot position in a pixel formed by the third discharge pulse PeB12 in the first period LAT1 with the dot position in a pixel formed by the fourth discharge pulse PeB22 in the second period LAT2.

1.4 Selection of Pulse and Formation of Dot

Figure 6:
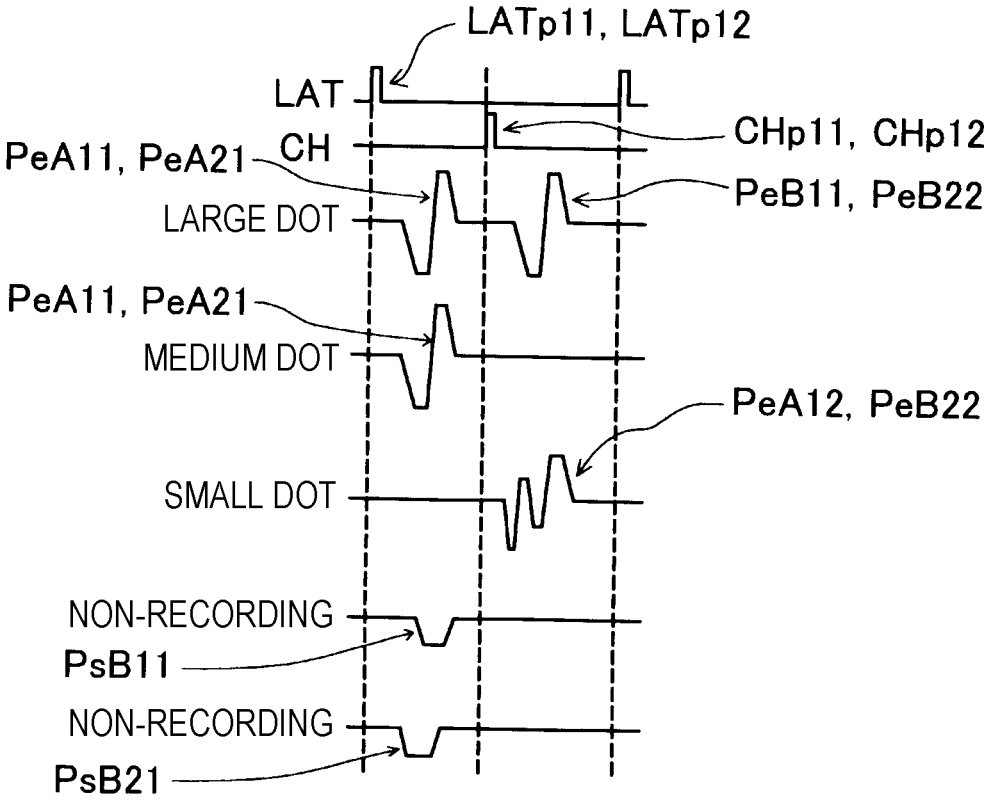
FIG. 6 is a chart illustrating a drive signal Vout when a large dot, a medium dot, a small dot, and non-recording are printed on a pixel out of two pixels corresponding to one print cycle Tc.

In the present embodiment, in a drive cycle of the first drive signal COM-A and the second drive signal COM-B, a dot for one pixel is recorded in the first period LAT1, and a dot for one pixel is recorded in the second period LAT2. However, since a drive pulse selected in accordance with the size of a dot in each period is the same, for simplification of explanation, a description will be given by illustrating selection of drive pulses corresponding to a "large dot", a "medium dot", a "small dot" and "non-recording" in one pixel in FIG. 6. That is to say, FIG. 6 illustrates the portion of the drive signal Vout in the first period LAT1 or the second period LAT2. Also, in the present embodiment, the length of the first period LAT1 differs from the length of the second period LAT2. However, for simplification of explanation, a description will be given as if the lengths are the same.

When a "large dot" is to be formed in a certain pixel, a discharge pulse is selected in the first half of the LAT period corresponding to the pixel, and a discharge pulse is also selected in the second half of the LAT period. Specifically, for outputting the drive signal Vout corresponding to the case where a "large dot" is discharged in the first period LAT1, the first discharge pulse PeA11 of the first drive signal COM-A is selected in the period from LATp11 to CHp11, and the third discharge pulse PeB12 of the second drive signal COM-B is selected in the period from CHp11 to LATp12. For outputting the drive signal Vout corresponding to the case where a "large dot" is discharged, the second discharge pulse PeA21 of the first drive signal COM-A is selected in the period from LATp12 to CHp12 in the second period LAT2, and the fourth discharge pulse PeB22 of the second drive signal COM-B is selected in the period from CHp12 to the end of the print cycle Tc. As a result, the medium amount of ink droplet is discharged twice in one LAT period. A large dot is formed by those ink droplets.

When a "medium dot" is to be formed in a certain pixel, the discharge pulse is selected in the first half of the LAT period corresponding to the pixel, and no pulse is selected in the second half of the LAT period. Specifically, for outputting the drive signal Vout when a "medium dot" is discharged in the first period LAT1, the first discharge pulse PeA11 of the first drive signal COM-A is selected in the period from LATp11 to CHp11, and no pulses of the first and the second drive signals COM-A and COM-B are selected in the period from CHp11 to LATp12. For outputting the drive signal Vout corresponding to the case where a "medium dot" is discharged in the second period LAT2, the second discharge pulse PeA21 of the first drive signal COM-A is selected in the period from LATp12 to CHp12, and no pulses of the first and the second drive signals COM-A and COM-B are selected in the period from CHp12 to the end of the print cycle Tc. As a result, the medium amount of ink droplet is discharged once in one LAT period. A medium dot is formed on the medium PM by the ink droplet.

When a "small dot" is to be formed in a certain pixel, no pulse is selected in the first half of the LAT period corresponding to the pixel, and a discharge pulse is selected in the second half of the LAT period. Specifically, for outputting the drive signal Vout corresponding to the case where a "small dot" is discharged in the first period LAT1, and no pulses of the first and the second drive signals COM-A and COM-B are selected in the period from LATp11 to CHp11, and the fifth discharge pulse PeA12 of the first drive signal COM-A is selected in the period from CHp11 to LATp12. For outputting the drive signal Vout corresponding to the case where a "small dot" is discharged in the second period LAT2, no pulses of the first and second drive signals COM-A and COM-B are selected from the period from LATp12 to CHp12, and the sixth discharge pulse PeA22 of the first drive signal COM-A is selected in the period from CHp12 to the end of the print cycle Tc. As a result, the small amount of ink droplet is discharged once in one LAT period. A small dot is formed on the medium PM by the ink droplet.

At the time of "non-recording" in which a dot is not recorded on a certain pixel, a micro-vibration pulse is selected in the first half of the LAT period corresponding to the pixel, and no pulse is selected in the second half of the LAT period. Specifically, for outputting the drive signal Vout corresponding to the case of "non-recording" in the first period LAT1, the first micro-vibration pulse PsB11 of the second drive signal COM-B is selected in the period from LATp11 to CHp11, and neither the first drive signal COM-A nor the second drive signal COM-B is selected in the period from CHp11 to LATp12. As a result, ink in the vicinity of the nozzle 21 is micro-vibrated in one LAT period, and thus ink is not discharged. The micro-vibration of ink enables the ink in the nozzle 21 to flow even in the LAT period when ink is not discharged. As a result, it is possible to prevent part of ink from staying in the nozzle 21 for a long time and increasing the viscosity of the ink.

In reality, the Vout including a drive pulse selected correspondingly to any one of a large dot, a medium dot, a small dot, and non-recording in the first period LAT1, and a drive pulse selected correspondingly to any one of a large dot, a medium dot, a small dot, and non-recording in the second period LAT2 in the print cycle Tc is applied to the piezoelectric actuator 300.

Figure 7:
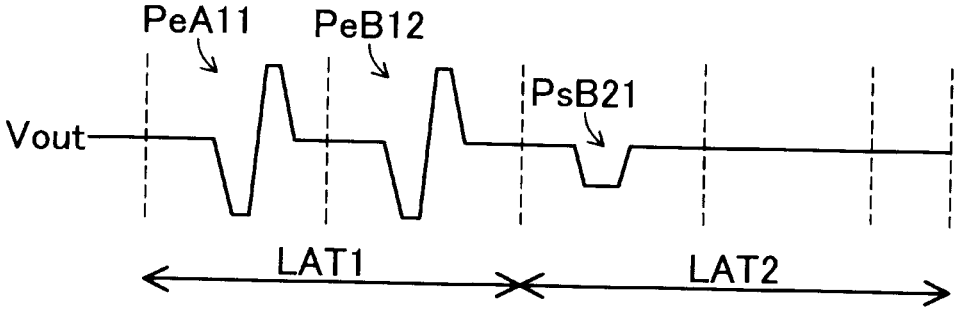
FIG. 7 is a chart illustrating the drive signal Vout when a large dot is formed on a first pixel, and a dot is not formed on a second pixel out of two pixels corresponding to one print cycle Tc.

FIG. 7 is a chart illustrating the drive signal Vout when a large dot is formed in the first pixel of the two pixels corresponding to one print cycle Tc, and a dot is not formed in the second pixel as an example of the Vout including the first period LAT1 and the second period LAT2 (refer to the right part of FIG. 4).

FIG. 7 illustrates an example of the Vout including the first period LAT1 and the second period LAT2. FIG. 7 illustrates an example in which a large dot is formed in the first period LAT1, and "non-recording", which does not record a dot, is performed in the second period LAT2. The first discharge pulse PeA11 of the first drive signal COM-A is selected in the first half of the first period LAT1, and the third discharge pulse PeB12 of the second drive signal COM-B is selected in the second half. The second micro-vibration pulse PsB21 of the second drive signal COM-B is selected in the first half of the second period LAT2, and neither the drive signal COM-A nor the drive signal COM-B is selected in the second half. As a result, the medium amount of ink droplets is discharged twice in the first period LAT1, the ink of those ink droplets forms a large dot on the medium PM by, and the ink in the vicinity of the nozzle 21 is micro-vibrated in the first half of the second period LAT2 so that ink is not discharged.

1.5. Length of First Period LAT1 and Length of Second Period LAT2

The timing signal PTS is sometimes not precisely generated at regular intervals due to a production error of the belt 24*b* that moves the carriage 24*c* or a production error of the encoder that detects the position of the carriage 24*c* (refer to FIG. 1). In FIG. 5, a pulse PTSp2 of the timing signal on the rear side that is sent at earliest is illustrated as PTSp2*s* (refer to the lower center part of FIG. 5). It is possible to obtain the timing of the pulse PTSp2*s* of the timing signal experimentally.

In FIG. 5, the pulse of the LAT signal corresponding to the pulse PTSp2*s* of the timing signal is denoted by LATp21*s* (refer to the lower center part of FIG. 5). At this time, the print cycle Tc from the front-side timing signal pulse PTSp1 to the rear-side timing signal pulse PTSp2*s* is the shortest compared with the ideal length. The cycle Tc when the repetition cycle Tc becomes the shortest is denoted by cycle Tcmin in FIG. 5 (refer to the upper center part of FIG. 5). The first discharge pulse PeA11 of the first drive signal COM-A of the next cycle at that time is denoted by a first discharge pulse PeA11*s* using a broken line (refer to the upper right part of FIG. 5). A first micro-vibration pulse PsB11*s* of the second drive signal COM-B of the next cycle is denoted by a broken line (refer to the middle right part of FIG. 5).

The controller 122 outputs a pulse of the LAT signal at (i) the time when a pulse of the timing signal PTS is received, and at (ii) the time when a certain time shorter than ½ the reference value Tc0 of the repetition cycle of the timing signal PTS has passed from the time when a pulse of the timing signal PTS is received (refer to the lower part of FIG. 5). It is possible to determine the certain time shorter than ½ the reference value Tc0 of the print cycle Tc based on the print cycle Tcmin of when the generation timing of the rear-side timing signal PTS is the earliest with respect to the front-side timing signal PTS. It is possible to obtain the print cycle Tcmin by experiment. When the Tcmin is R % of the reference value Tc0, it is possible to determine the certain time shorter than ½ the reference value Tc0, for example, to be an R % value of ½ the reference value Tc0.

In such a mode, when the rear-side timing signal PTS is generated at a point in time when the reference value Tc0 of the print cycle Tc has passed from the generation timing of the front-side timing signal PTS, the length of the second period LAT2 becomes longer than the length of the first period LAT1 (refer to the lower part of FIG. 5).

With such a configuration, when the next timing signal PTS is generated at the shortest interval from the generation timing of the front-side timing signal PTS, it is possible to dispose a margin period on the rear side so as to apply a drive pulse of the second period LAT2. As a result, after generating a pair of the first drive signal COM-A and the second drive signal COM-B in synchronism with the front-side timing signal PTS, when the next one pair of the first drive signal COM-A and the second drive signal COM-B is generated in synchronism with the next timing signal PTS generated at early timing corresponding to the print cycle Tcmin, the following advantages are obtained (refer to PeA11*s* and PsB11*s* in FIG. 5). That is to say, in the case of the shortest print cycle Tcmin, it is possible to apply drive pulses included in the first drive signal COM-A and the second drive signal COM-B to the piezoelectric actuator 300 in one print cycle.

1.6. Occurrence Timing of First Micro-Vibration Pulse PsB11 and Second Micro-Vibration Pulse PsB21

In the present embodiment, the length A1 of the period from the start of the first period LAT1 to the start of the first micro-vibration pulse PsB11 differs from the length A2 of the period from the start of the second period LAT2 to the start of the second micro-vibration pulse PsB21 (refer to the middle left part of FIG. 5).

As described above, when the length of the period from the start of the LAT period to the start of the first micro-vibration pulse PsB11, A1, and that of the second micro-vibration pulse PsB21, A2, do not match with each other, the quality of an image formed on the medium PM is not affected. Accordingly, it is possible to set the length A2 of the period from the start of the second period LAT2 to the start of the second micro-vibration pulse PsB21, that is to say, the start timing of the second micro-vibration pulse PsB21 without being restrained by the length A1 of the period from the start of the first period LAT1 to the start of the first micro-vibration pulse PsB11. As a result, regardless of the fluctuations of the repetition cycle Tc, it is possible to set the start timing of the second micro-vibration pulse PsB21 so that instability of the pulses in the first period LAT1 after that, which is cause by the second micro-vibration pulse PsB21, is unlikely to occur (refer to PeA11*s* and PsB11*s* in FIG. 5).

In the same manner, it is possible to set the length A1 of the period from the start of the first period LAT1 to the start of the first micro-vibration pulse PsB11 without being restrained by the length A2 of the period from the start of the second period LAT2 to the start of the second micro-vibration pulse PsB21. As a result, it is possible to set the start timing of the first micro-vibration pulse PsB11 so that instability of the pulses in the second period LAT2 after that, which is caused by the first micro-vibration pulse PsB11, is unlikely to occur.

As described above, when a drive pulse is applied to the piezoelectric actuator 300, a pressure change occurs in the ink in the pressure chamber 12. After the pressure change has occurred, a residual vibration occurs in the ink in the pressure chamber 12. For example, when Vout exemplified in FIG. 7 is applied to the piezoelectric actuator 300, a residual vibration occurs after the application of the third discharge pulse PeB12. After that, a pressure change due to the second micro-vibration pulse PsB21 is overlapped on the residual vibration, and a residual vibration occurs after the application of the second micro-vibration pulse PsB21. Further, a residual vibration, to which a pressure change due to the drive pulse applied in the succeeding print cycle is further overlapped, occurs.

Here, the residual vibration that occurs in the pressure chamber 12 after a drive pulse is applied to the piezoelectric actuator 300 declines after repeating amplitude vibrations. When the next drive pulse is applied in the state of having a residual vibration, the behavior of the meniscus, which is the liquid surface of the ink in the nozzle 21, differs depending on the size and the phase of the residual vibration at the timing of being applied the drive pulse. For example, in the state in which the meniscus in the nozzle 21 is pulled in the pressure chamber 12 by the residual vibration, when the piezoelectric layer 70 is deformed by a drive pulse so that the volume of the pressure chamber 12 increases, a pressure change in the ink in the pressure chamber 12 is encouraged. On the other hand, in the state in which the meniscus in the nozzle 21 is pushed out in the opposite side of the pressure chamber 12 due to the residual vibration, when the piezoelectric body layer 70 is deformed by a drive pulse so that the volume of the pressure chamber 12 increases, the vibration of the pressure change in the ink in the pressure chamber 12 is damped. Further, the flow of the ink in the pressure chamber 12 and the nozzle 21 differs depending on the relationship between the amplitude magnitude of the residual vibration and the amount of a pressure change given by the drive pulse to the ink in the pressure chamber 12 at the timing of application of the drive pulse.

Accordingly, it is desirable that the length A1 of the period from the start of the first period LAT1 to the start of the first micro-vibration pulse PsB11 and the length A2 of the period from the start of the second period LAT2 to the start of the second micro-vibration pulse PsB21 be determined such that the residual vibration that occurs after the application of the micro-vibration pulse does not vary greatly without depending on the deviation of the generation timing of the timing signal PTS regardless of whether or not a drive pulse is applied in the LAT period before the individual micro-vibration pulses are applied.

In the present embodiment, specifically, the length A1 of the period from the start of the first period LAT1 to the start of the first micro-vibration pulse PsB11 is longer than the length A2 of the period from the start of the second period LAT2 to the stat of the second micro-vibration pulse PsB21 (refer to the middle right part of FIG. 5).

In the example in FIG. 5, in the second drive signal COM-B, a time period from the end time of the third discharge pulse PeB12, which is the last pulse of the first period LAT1, to the start time of the second micro-vibration pulse PsB21, which is the first pulse in the second period LAT2, is assumed to be time T12 (refer to the center part of FIG. 5). It is possible to set the time T12 based on an experiment or a simulation so as to apply the second micro-vibration pulse PsB21 at a desired timing to the residual vibration when the fifth discharge pulse PeA12 is applied, and the first discharge pulse PeA11 and the third discharge pulse PeB12 are applied in the first period LAT1. Also, in the second drive signal COM-B, a time period from the end time of the fourth discharge pulse PeB22, which is the last pulse of the second period LAT2 of the previous print cycle Tc, to the start time of the first micro-vibration pulse PsB11*s*, which is the first pulse of the next first period LAT1 when the pulse PTSp2*s* of the next timing signal is sent earliest is assumed to be time T21*s*. It is possible to set the time T21*s* based on an experiment or a simulation so as to apply the first micro-vibration pulse PsB11 at a desired timing to the residual vibration when the sixth discharge pulse PeA22 is applied, and the second discharge pulse PeA21 and the fourth discharge pulse PeB22 are applied in the second period LAT2 of the previous print cycle Tcmin. In the present embodiment, it is desirable that in the length A1 of the period from the start of the first period LAT1 to the start of the first micro-vibration pulse PsB11, the time T12 and the time T21*s* be determined to be the same. Thereby, it is possible to apply the first micro-vibration pulse PsB11 at timing suitable for the amplitude and the phase of the residual vibration that has occurred in the second period LAT2 of the previous print cycle Tcmin. Thereby, it is possible to discharge ink favorably when a discharge pulse is applied in the next second period LAT2. In this regard, in the first drive signal COM-A, it is desirable that a time period from the end time of the sixth discharge pulse PeA22, which is the last pulse of the second period LAT2 of the previous print cycle Tc, to the start time of the first micro-vibration pulse PsB11*s*, which is the first pulse of the next first period LAT1 when the pulse PTSp2*s* of the next timing signal is sent earliest be time T21*s*.

With such a configuration, when the repetition cycle Tc becomes as short as the print cycle Tcmin, regardless of whether a drive pulse in the second period LAT2 of the previous print cycle is selected or not, it is possible to apply a discharge pulse to the residual vibration that occurs after the application of the first micro-vibration pulse PsB11 in the first period LAT1 of the print cycle at this time at good timing in the second period LAT2 to discharge droplets favorably.

In the present embodiment, a discharge pulse and a micro-vibration pulse are disposed both in the first period LAT1 and the second period LAT2. Accordingly, it becomes possible to perform printing corresponding to one pixel individually in the first period LAT1 and the second period LAT2. Also, in the first period LAT1, one of a discharge pulse and a micro-vibration pulse is included in the first drive signal COM-A, and the other of the pulses is included in the second drive signal COM-B, and in second period LAT2, one of a discharge pulse and a micro-vibration pulse is included in the first drive signal COM-A, and the other of the pulses is included in the second drive signal COM-B. Accordingly, it is possible to shorten the repetition cycle of the drive signal compared with the case where a discharge pulse and a micro-vibration pulse are included in the first period LAT1 in one drive signal, and a discharge pulse and a micro-vibration pulse are included in the second period LAT2. Thus it is possible to improve the print speed. Further, when the print speed is improved, it is possible to prevent a discharge failure caused by a residual vibration that occurs after the application of a drive pulse and to suppress deterioration of print quality.

The liquid discharge head 1 according to the present embodiment may be referred to as a "head". The piezoelectric actuator 300 may be referred to as a "pressure generation unit". The control unit 121 may be referred to as a "drive signal generation section". The drive IC 1D may be referred to as a "drive controller".

2. OTHER EMBODIMENTS

Figure 8:
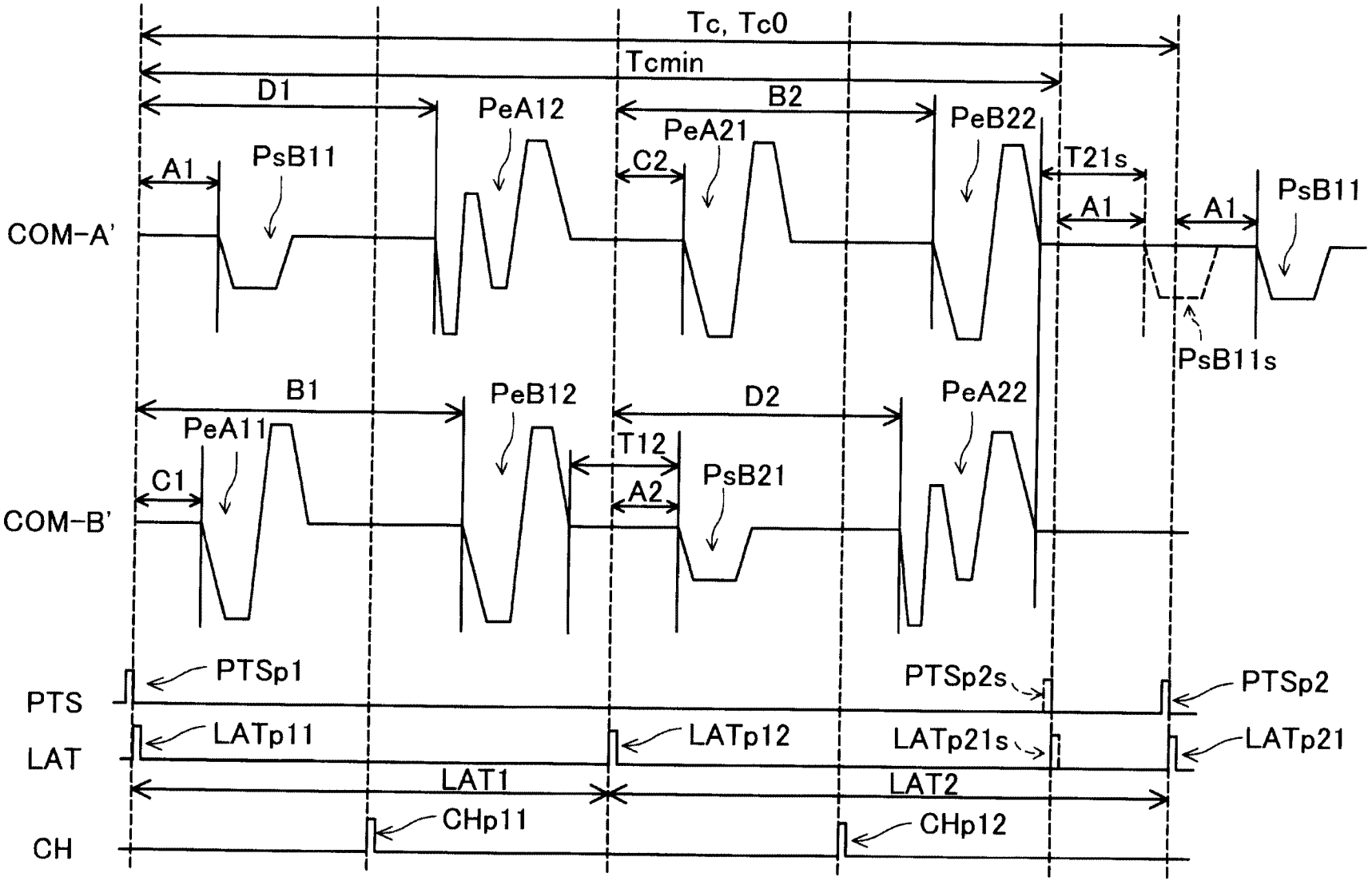
FIG. 8 is a chart illustrating the configuration of the first drive signal COM-A and the second drive signal COM-B according to other first embodiment.

2.1 Other First Embodiment (1) In the above-described embodiment, both the first micro-vibration pulse PsB11 and the second micro-vibration pulse PsB21 are included in the second drive signal COM-B. However, at least one of the first micro-vibration pulse PsB11 and the second micro-vibration pulse PsB21 may be included in the first drive signal COM-A. FIG. 8 illustrates an example in which the first micro-vibration pulse PsB11 is included in the first drive signal COM-A, and the second micro-vibration pulse PsB21 is included in the second drive signal COM-B.

FIG. 8 is a chart illustrating the configuration of a first drive signal COM-A' and a second drive signal COM-B' according to the present embodiment. A plurality of drive pulses included in the first drive signal COM-A' include the first micro-vibration pulse PsB11, the second discharge pulse PeA21, the fifth discharge pulse PeA12, and the sixth discharge pulse PeB22. Further, a plurality of drive pulses included in the second drive signal COM-B' include the first discharge pulse PeA11, the third discharge pulse PeB12, the second micro-vibration pulse PsB21, and the fourth discharge pulse PeA22. The other characteristics are the same as that of the embodiment described above.

Also, further, it is possible that a plurality of drive pulses included in the first drive signal COM-A according to the above-described embodiment may be included in the second drive signal COM-B, and a plurality of drive pulses included in the second drive signal COM-B according to the above-described embodiment may be included in the first drive signal COM-A.

Figure 9:
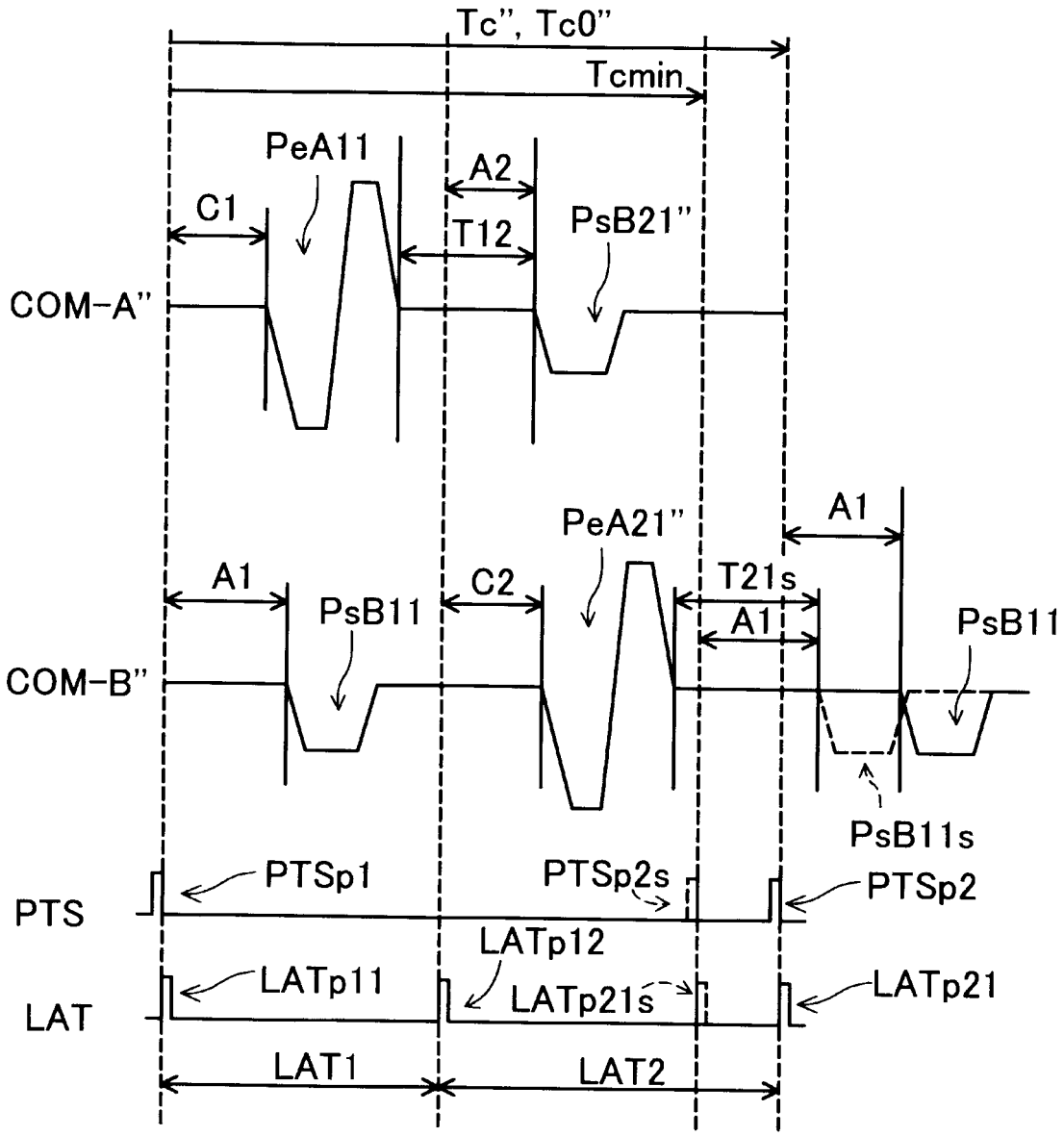
FIG. 9 is a chart illustrating the configuration of the first drive signal COM-A and the second drive signal COM-B according to a variation of the other first embodiment.

Also, further, FIG. 9 is a chart illustrating the configuration of a first drive signal COM-A" and a second drive signal COM-B" according to a variation of the present embodiment. A plurality of drive pulses included in the first drive signal COM-A" include the first discharge pulse PeA11 and a second micro-vibration pulse PsB21". Further, a plurality of drive pulses included in the second drive signal COM-B" includes the first micro-vibration pulse PsB11 and the second discharge pulse PeA21". In the above-described embodiment, the first drive signal COM-A and the second drive signal COM-B include a plurality of drive pulses individually in the first period LAT1 and the second period LAT. However, in this variation, the first drive signal COM-A" and the second drive signal COM-B" include one drive pulse individually in the first period LAT1 and in the second period LAT.

In this variation, in a drive cycle of the first drive signal COM-A" and the second drive signal COM-B", dots for one pixel are recorded by a drive pulse in the first period LAT1, and dots for one pixel are recorded by a drive pulse in the second period LAT2. In this variation, when a discharge pulse is selected in one pixel, a "medium dot" is printed, and when a micro-vibration pulse is selected, "non-recording" is performed.

The length C1 of the period from the start of the first period LAT1 to the start of the first discharge pulse PeA11 is equal to the length C2 of the period from the start of the second period LAT2 to the start of the second discharge pulse PeA21". Also, the length A1 of the period from the start of the first period LAT1 to the start of the first micro-vibration pulse PsB11 is longer than the length A2 of the period from the start of second period LAT2 to the start of the second micro-vibration pulse PsB21".

In the second drive signal COM-B", it is assumed that the time from the end time of the second discharge pulse PeA21, which is the last pulse of the second period LAT2 of the previous print cycle Tc, to the start time of the first micro-vibration pulse PsB11*s*, which is the first pulse of the next first period LAT1 when the pulse PTSp2*s* of the next timing signal is sent earliest is time T21*s*. Based on an experiment or a simulation, it is possible to set the time T21*s* so as to apply the first micro-vibration pulse PsB11 at desired timing to the residual vibration when the second discharge pulse PeA21 is applied in the second period LAT2 of the previous print cycle Tcmin. In the present embodiment, it is desirable that the length A1 of the period from the start of the first period LAT1 to the start of the first micro-vibration pulse PsB11 be determined such that the time T12 and the time T21*s* become equal. Thereby, it is possible to apply the first micro-vibration pulse PsB11 at timing suitable for the amplitude and the phase of the residual vibration that has occurred in the second period LAT2 of the previous print cycle Tcmin. Thereby, it is possible to discharge ink favorably when a discharge pulse is applied in the next second period LAT2. In this regard, a discharge pulse disposed individually in the first period LAT1 and the second period LAT2 may be a discharge pulse for a small dot instead of a discharge pulse for discharging a medium dot.

In short, when a discharge pulse and a micro-vibration pulse are disposed both in the first period LAT1 and the second period LAT2, and the pulses are assigned to the first drive signal COM-A or the second drive signal COM-B, it is possible to print two pixels in one print cycle Tc.

(2) In the above-described embodiment, one print cycle Tc includes the first period LAT1 and the second period LAT2 that are separated by a LAT signal (refer to the lower part of FIG. 5). However, one print cycle Tc may include the other one or more periods LAT between the first period LAT1 and the second period LAT2. Such other periods LAT may include one or more drive pulses, or may not include a drive pulse.

(3) In the above-described embodiment, the control unit 121 repeatedly generates a timing signal PTS in accordance with a change in the relative position between the medium PM and the liquid discharge head 1, and further outputs a pulse of the LAT signal based on the timing pulse PTS (refer to the lower part of FIG. 5 and the right part of FIG. 4). However, both the timing signal PTS and the LAT signal may be generated by the other components, or either of signals may be generated by the other component.

2.2 Other Second Embodiment

In the above-described embodiment, specifically, the length A1 of the period from the start of the first period LAT1 to the start of the first micro-vibration pulse PsB11 is longer than the length A2 of the period from the start of the second period LAT2 to the start of the second micro-vibration pulse PsB21 (refer to the middle right part of FIG. 5). However, it is possible to employ a mode in which the length of the period from the start of the first period to the start of the first micro-vibration pulse is shorter than the length of the period from the start of the second period to the start of the second micro-vibration pulse.

When the following conditions are met, the length of the period from the start of the first period to the start of the first micro-vibration pulse is shorter than the length of the period from the start of the second period to the start of the second micro-vibration pulse. When the amplitude of the residual vibration is small to some degree after either the sixth discharge pulse PeA22 or the fourth discharge pulse PeB22 is selected in the second period LAT2 having a short print cycle Tc, the print cycle Tcmin, and the behavior of the meniscus in the nozzle 21 at the time of having been applied a pressure change of the ink by the first micro-vibration pulse PsB11 in the first period LAT of the next print cycle and the residual vibration after that do not have an adverse effect on discharging a discharge pulse after that in the second period LAT2.

2.3 Other Third Embodiment

In the above-described embodiment, the length A1 of the period from the start to the start of the first period LAT1 to the start of the first micro-vibration pulse PsB11 differs from the length A2 of the period from the start of the second period LAT2 to the start of the second micro-vibration pulse PsB21, the length B1 of the period from the start of the first period LAT1 to the start of the third discharge pulse PeB12 is equal to the length B2 of the period from the start of the second period LAT2 to the start of the fourth discharge pulse PeB22, and the length D1 of the period from the start of the first period LAT1 to the start of the fifth discharge pulse PeA12 is equal to the length D2 of the period from the start of the second period LAT2 to the start of the sixth discharge pulse PeA22. However, it is possible to set such that A is equal to A2, B1 differs from B2 with each other, and D1 differs from D2 with each other.

Figure 10:
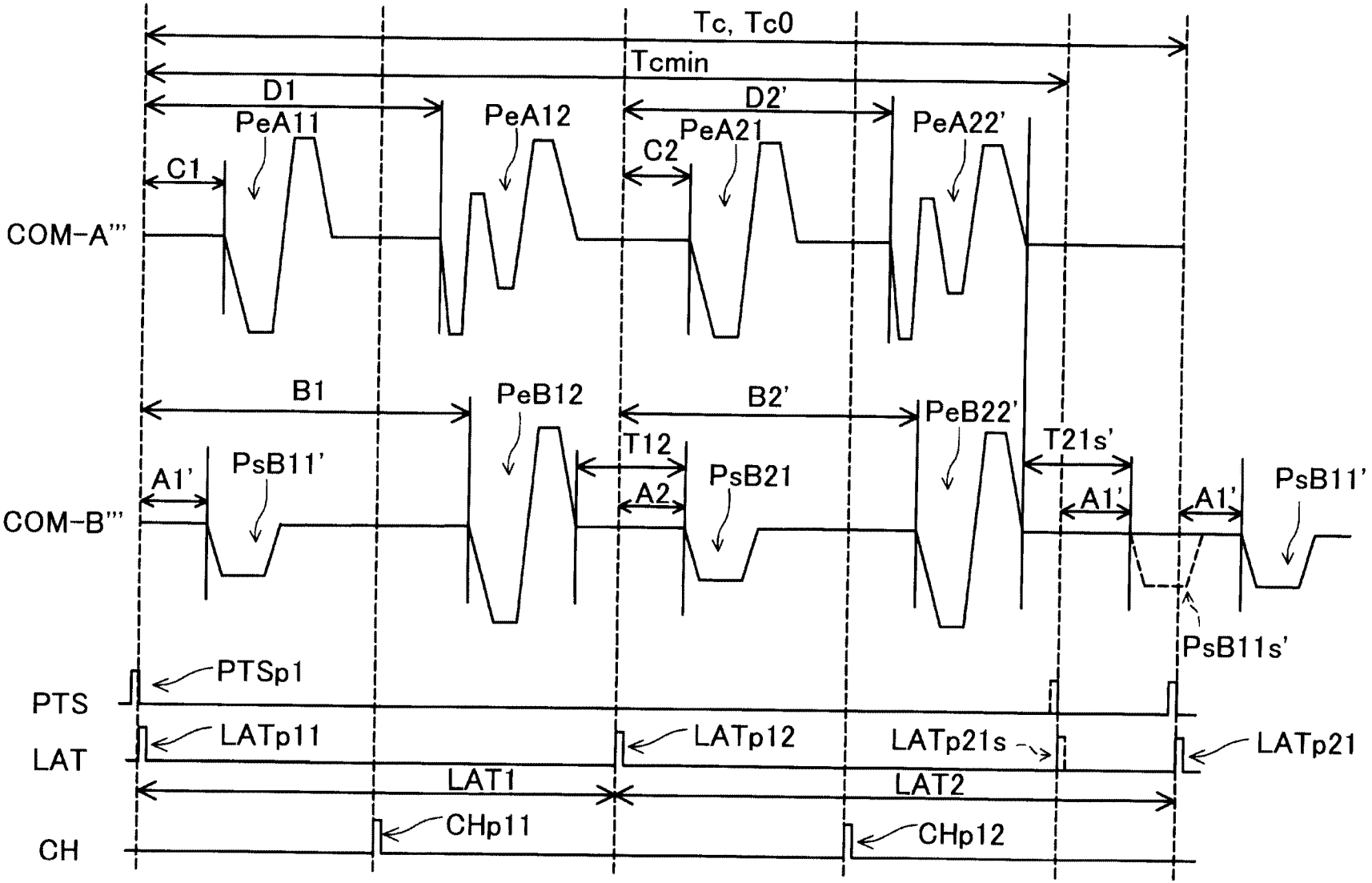
FIG. 10 is a chart illustrating the configuration of the first drive signal COM-A and the second drive signal COM-B according to other third embodiment.

FIG. 10 is a chart illustrating the configuration of a first drive signal COM-A'" and a second drive signal COM-B'" according to the present embodiment. In the present embodiment, the length A1' of the period from the start of the first period LAT1 to the start of the first micro-vibration pulse PsB11' is equal to the length A2 of the period from the start of the second period LAT2 to the start of the second micro-vibration pulse PsB21. The length B1 of the period from the start of the first period LAT1 to the start of the third discharge pulse PeB12 differs from the length B2' of the period from the start of the second period LAT2 to the start of the fourth discharge pulse PeB22'. Further, the length D1 of the period from the start of the first period LAT1 to the start of the fifth discharge pulse PeA12 differs from the length D2' of the period from the start of the second period LAT2 to the start of the sixth discharge pulse PeA22'. The other characteristics are the same as those of the embodiment described above.

In the example in FIG. 10, in the second drive signal COM-B'", it is assumed that the time period from the end time of the fourth discharge pulse PeB22', which is the last pulse of the second period LAT2 of the previous print cycle Tc, to the start time of the first micro-vibration pulse PsB11*s'*, which is the first pulse of the next first period LAT1 when the pulse PTSp2*s* of the next timing signal is sent earliest, is time T21*s'*. Based on an experiment or a simulation, it is possible to set the time T21*s'* so as to apply the first micro-vibration pulse PsB11' at desired timing to the residual vibration when the sixth discharge pulse PeA22' is applied in the second period LAT2 of the previous print cycle Tcmin, and the second discharge pulse PeA21 and the fourth discharge pulse PeB22' are applied. In the present embodiment, it is desirable that the length B2' of the period from the start of the second period LAT2 to the start of the fourth discharge pulse PeB22' be determined such that the time T12 becomes equal to the time T21*s'*. Also, in the present embodiment, in the first drive signal COM-A', it is desirable that the time period from the end time of the sixth discharge pulse PeA22', which is the last pulse of the second period LAT2 of the previous print cycle Tc, to the start time of the first micro-vibration pulse PsB11*s'*, which is the first pulse of the next first period LAT1 when the pulse PTSp2*s* of the next timing signal is sent earliest be determined as time T21*s'*. Thereby, it is possible to apply the first micro-vibration pulse PsB11 at timing suitable for the amplitude and the phase of the residual vibration that has occurred in the second period LAT2 of the previous print cycle Tcmin. Thereby, it is possible to discharge ink favorably when a discharge pulse is applied in the next second period LAT2.

2.4 Other Fourth Embodiment

In the above-described embodiment, the front end of the first period LAT1 is specified by the pulse LATp11 of the LAT signal, and the front end of the second period LAT2 is specified by the pulse LATp12 of the LAT signal. However, it is possible to specify the front end of the first period LAT1 and the front end of the second period LAT2 by a signal other than the LAT signal. For example, it is possible to identify the front end of the first period LAT1 as the time when going back for a predetermined period C' in time from the start of the discharge pulse that appears at the earliest timing among the discharge pulses corresponding to the first pixel in the first drive signal COM-A and the second drive signal COM-B. In this case, it is possible to identify the front end of the second period LAT2 as the time when going back for a predetermined period C' in time from the start of the discharge pulse that appears at the earliest timing among the discharge pulses corresponding to the second pixel in the first drive signal COM-A and the second drive signal COM-B.

3. Still Other Modes

The present disclosure is not limited to the above-described embodiments, and it is possible to realize the present disclosure in various ways without departing from the spirit and scope of the disclosure. For example, it is possible to realize the present disclosure in the following modes. It is possible to suitably replace and combine the technical features in the embodiments described above that are corresponding to the technical features described in the following in order to solve part of or all of the problems of the present disclosure or to realize part of or all of the advantages. Also, it is possible to suitably remove the technical features unless the technical features are described as necessities in this specification.

(1) According to an aspect of the present disclosure, there is provided a liquid discharge apparatus. The liquid discharge apparatus includes a head including a nozzle, a pressure chamber communicating with the nozzle, and a pressure generation unit causing a pressure change in liquid in the pressure chamber; a drive signal generation section configured to repeatedly generate a first drive signal including a plurality of drive pulses in a repetition cycle and a second drive signal including a plurality of drive pulses in the repetition cycle in synchronism with each other; and a drive controller configured to supply a pulse selected from the plurality of drive pulses included in the first drive signal or the second drive signal to the pressure generation unit. The plurality of drive pulses include a first discharge pulse and a second discharge pulse that generate the pressure change so as to discharge liquid from the nozzle and a first micro-vibration pulse and a second micro-vibration pulse that generate the pressure change so as not to discharge liquid from the nozzle. The first drive signal includes one of the first discharge pulse and the first micro-vibration pulse in a first period included in the repetition cycle and includes one of the second discharge pulse and the second micro-vibration pulse in a second period included in the repetition cycle and later than the first period. The second drive signal includes the other of the first discharge pulse and the first micro-vibration pulse in the first period and includes the other of the second discharge pulse and the second micro-vibration pulse in the second period. The length of a period from the start of the first period to the start of the first micro-vibration pulse differs from the length of a period from the start of the second period to the start of the second micro-vibration pulse. In such a mode, it is possible to set the period from the start of the second period to the start of the second micro-vibration pulse, that is to say, the start timing of the second micro-vibration pulse without being restrained by the period from the start of the first period to the start of the first micro-vibration pulse. As a result, it is possible to apply at suitable timing the micro-vibration pulse of the next repetition cycle to the residual vibration that has occurred in the previous repetition cycle regardless of the fluctuations of the repetition cycle. Accordingly, it is possible to prevent instability of discharging ink after applying the micro-vibration pulse.

(2) In the liquid discharge apparatus described above, the length of the period from the start of the first period to the start of the first micro-vibration pulse may be longer than the length of the period from the start of the second period to the start of the second micro-vibration pulse. With such a mode, even when the repetition cycle becomes short, it is possible to apply a micro-vibration pulse of the next repetition cycle at the timing when the residual vibration that has occurred in the previous repetition cycle is attenuated. Accordingly, it is possible to prevent instability of discharging ink after applying the micro-vibration pulse.

(3) In the liquid discharge apparatus described above, the length of a period from the start of the first period to the start of the first discharge pulse may be equal to the length of a period from the start of the second period to the start of the second discharge pulse.

(4) In the liquid discharge apparatus described above, either the first drive signal or the second drive signal may include in the first period the first micro-vibration pulse and a third discharge pulse that is located behind the first micro-vibration pulse and that causes the pressure change so as to discharge liquid from the nozzle, either the first drive signal or the second drive signal may include in the second period the second micro-vibration pulse and a fourth discharge pulse that is located behind the second micro-vibration pulse and that causes the pressure change so as to discharge liquid from the nozzle, and the length of a period from the start of the first period to the start of the third discharge pulse may be equal to the length of a period from the start of the second period to the start of the fourth discharge pulse.

In this regard, in the liquid discharge apparatus described above, when the second period includes the rear end of the repetition cycle, and the drive signal generation section repeatedly generates the first drive signal and the second drive signal at a constant cycle, the length of the second period may be longer than the length of the first period. In such a mode, even when the repetition cycle is short, it is possible to take a long time until the rear end of the repetition cycle after the last pulse in the second period ends. As a result, it is possible to obtain the following advantages when after a pair of the first drive signal and the second drive signal in synchronism with each other is generated, the drive signal generation section generates the next pair of the first drive signal and the second drive signal at an earlier timing than expected. That is to say, it is possible to reduce the impact of the pulse generated last in the previous cycle on the pressure change caused by the pulse of the next cycle.

It is possible to realize the present disclosure in various modes other than a liquid discharge apparatus. For example, it is possible to realize the present disclosure in the mode of a printer, a control method of a liquid discharge apparatus, a printer control method, a printing method, a computer program for realizing those methods, a non-transitory recording medium recording the computer program, and the like.

What is claimed is:

1. A liquid discharge apparatus comprising:

a head including a nozzle, a pressure chamber communicating with the nozzle, and a pressure generation unit configured to cause a pressure change in liquid in the pressure chamber;

a drive signal generation section configured to repeatedly generate a first drive signal including a plurality of drive pulses in a repetition cycle and a second drive signal including a plurality of drive pulses in the repetition cycle, the first drive signal being in synchronism with the second drive signal; and a drive controller configured to supply a pulse selected from the plurality of drive pulses included in the first drive signal or the second drive signal to the pressure generation unit, wherein the plurality of drive pulses include a first discharge pulse and a second discharge pulse that generate the pressure change so as to discharge liquid from the nozzle and a first micro-vibration pulse and a second micro-vibration pulse that generate the pressure change so as not to discharge liquid from the nozzle, the first drive signal includes one of the first discharge pulse and the first micro-vibration pulse in a first period included in the repetition cycle and includes one of the second discharge pulse and the second micro-vibration pulse in a second period included in the repetition cycle and later than the first period, the second drive signal includes the other of the first discharge pulse and the first micro-vibration pulse in the first period and includes the other of the second discharge pulse and the second micro-vibration pulse in the second period, a length of a period from a start of the first period to a start of the first micro-vibration pulse differs from a length of a period from a start of the second period to a start of the second micro-vibration pulse, in the first period, either the first drive signal or the second drive signal includes the first micro-vibration pulse and a third discharge pulse that is located behind the first micro-vibration pulse and that causes the pressure change so as to discharge liquid from the nozzle, in the second period, either the first drive signal or the second drive signal includes the second micro-vibration pulse and a fourth discharge pulse that is located behind the second micro-vibration pulse and that causes the pressure change so as to discharge liquid from the nozzle, and a length of a period from the start of the first period to a start of the third discharge pulse is equal to a length of a period from the start of the second period to a start of the fourth discharge pulse.

2. A liquid discharge apparatus comprising:

a head including a nozzle, a pressure chamber communicating with the nozzle, and a pressure generation unit configured to cause a pressure change in liquid in the pressure chamber;

a drive signal generation section configured to repeatedly generate a first drive signal including a plurality of drive pulses in a repetition cycle and a second drive signal including a plurality of drive pulses in the repetition cycle, the first drive signal being in synchronism with the second drive signal; and a drive controller configured to supply a pulse selected from the plurality of drive pulses included in the first drive signal or the second drive signal to the pressure generation unit, wherein the plurality of drive pulses include a first discharge pulse and a second discharge pulse that generate the pressure change so as to discharge liquid from the nozzle and a first micro-vibration pulse and a second micro-vibration pulse that generate the pressure change so as not to discharge liquid from the nozzle, the first drive signal includes one of the first discharge pulse and the first micro-vibration pulse in a first period included in the repetition cycle and includes one of the second discharge pulse and the second micro-vibration pulse in a second period included in the repetition cycle and later than the first period, the second drive signal includes the other of the first discharge pulse and the first micro-vibration pulse in the first period and includes the other of the second discharge pulse and the second micro-vibration pulse in the second period, a length of a period from a start of the first period to a start of the first micro-vibration pulse differs from a length of a period from a start of the second period to a start of the second micro-vibration pulse, and the waveform of the first discharge pulse and the second discharge pulse are the same.

3. The liquid discharge apparatus according to claim 2, wherein the waveform of the first micro-vibration pulse and the second micro-vibration pulse are the same.

4. The liquid discharge apparatus according to claim 2, wherein a dot for one pixel is printed in the first period, and a dot for one pixel is printed in the second period.

5. The liquid discharge apparatus according to claim 2, wherein the waveform of the first micro-vibration pulse and the second micro-vibration pulse are the same, and a dot for one pixel is printed in the first period, and a dot for one pixel is printed in the second period.

* * * * *